US011744343B1

(12) United States Patent
Perkins

(10) Patent No.: US 11,744,343 B1
(45) Date of Patent: Sep. 5, 2023

(54) HAIR STYLING APPARATUS

(71) Applicant: Kel'V Products LLC, Longview, TX (US)

(72) Inventor: Tamika Perkins, Longview, TX (US)

(73) Assignee: Kel'V Products LLC, Longview, TX (US)

( * ) Notice: Subject to any disclaimer, the term of this patent is extended or adjusted under 35 U.S.C. 154(b) by 0 days.

(21) Appl. No.: 17/840,530

(22) Filed: Jun. 14, 2022

(51) Int. Cl.
*A45D 1/02* (2006.01)
*A45D 1/06* (2006.01)
*A45D 1/04* (2006.01)

(52) U.S. Cl.
CPC *A45D 1/06* (2013.01); *A45D 1/04* (2013.01)

(58) Field of Classification Search
CPC ... A45D 1/04; A45D 1/06; A45D 1/08; A45D 2/48; A45D 2/001; A45D 2/002
See application file for complete search history.

(56) References Cited

U.S. PATENT DOCUMENTS 1,731,522 A * 10/1929 Carlson ..... A45D 1/04 132/224
5,957,140 A * 9/1999 McGee ..... A45D 1/04 132/226
6,070,596 A * 6/2000 Altamore ..... A45D 1/06 132/229
6,119,702 A 9/2000 Habibi
8,071,915 B2 * 12/2011 Mukai ..... A45D 1/04 132/224
8,967,159 B1 * 3/2015 Jenkins ..... A45D 2/002 132/223
9,872,549 B2 1/2018 Kock
10,702,036 B2 7/2020 Weatherly et al.
2005/0011533 A1 * 1/2005 Ruben ..... A45D 1/28 132/230
2005/0022836 A1 * 2/2005 Tong ..... A45D 1/16 132/224
2005/0150511 A1 * 7/2005 Park ..... A45D 1/00 132/224
2006/0137705 A1 * 6/2006 Barrett ..... A45D 1/18 132/224
2013/0220360 A1 * 8/2013 Sharon ..... C04B 35/80 427/180

(Continued)

FOREIGN PATENT DOCUMENTS

CN 202425817 U 9/2012
JP 2004358085 A 12/2004

(Continued)

*Primary Examiner* — Tatiana L Nobrega
(74) *Attorney, Agent, or Firm* — Lloyd & Mousilli; Jeoyuh Lin

(57) ABSTRACT

A hair styling apparatus, the apparatus including heating plate. The heating plate is defined by a free end and an attached end. The free end includes a top plate and a bottom plate that is separated by a gap configured to receive hair to be styled. The top plate and bottom plate are curved around a width of the hair styling apparatus. The gap is adjustable using a lever that is provided on a connecting handle that is connected to the attached end. The hair styling apparatus further includes a heater to heat the heating plate. The connecting handle also includes a gripping portion that enables gripping of the apparatus by a user. The hair styling apparatus also includes a power module to provide power to the heater.

13 Claims, 5 Drawing Sheets

(56) References Cited

U.S. PATENT DOCUMENTS

| | | | | |
|---|---|---|---|---|
| 2014/0034079 | A1* | 2/2014 | McCauley | A45D 1/04 132/229 |
| 2014/0318567 | A1* | 10/2014 | Douglas | A45D 2/367 132/232 |
| 2015/0047667 | A1* | 2/2015 | Mandica | A45D 2/001 132/211 |
| 2016/0213116 | A1* | 7/2016 | Williams | A45D 1/04 |
| 2017/0164707 | A1* | 6/2017 | Cowdry | A45D 2/001 |
| 2019/0387856 | A1* | 12/2019 | Nowak | A45D 6/00 |

FOREIGN PATENT DOCUMENTS

| | | | |
|---|---|---|---|
| KR | 200404348 | Y1 | 12/2005 |
| KR | 100837417 | B1 | 6/2008 |
| KR | 101320487 | B1 | 10/2013 |

* cited by examiner

HAIR STYLING APPARATUS

TECHNICAL FIELD

The present disclosure relates generally to a hair styling apparatus.

BACKGROUND

Hair styling is a very important part of an individual's fashion. Different occasions require different looks, and hair style is an integral feature of a person's self-image. Thus, quite often, a person is expected to change their hairstyle to go along with the outfit and/or the occasion. It may be desirable to straighten one's hair for a certain occasion, while other situations warrant a big wave.

As a consequence to the demands of hair styling by individuals, hair styling tools and apparatus play a very important role in an individual's lives. A typical hair styling apparatus consists of a circuit and a heater to heat hair strands at a predetermined temperature range. Heated hair strands soften, which allows them to be suitably adjusted to give a desired shape. Most common heaters available in the market are cylindrical-shaped (for curling hair) and flat-shaped (for straightening hair).

Traditional flat iron hair tools generate high temperatures, which increases the chances of hair damage. Additionally, using flat irons with jaw-shaped clamps for hair straightening breaks down hair strands, making them brittle and forming split-ends. Further, current hair dressing procedures include several complicated steps that are both time-consuming and harmful to hair strands. Further, long and repeated use of such products results in damage to the scalp, which in turn lead to further unpleasant consequences such as skin irritation, hair loss, skin-burn, and so on.

Therefore, there is a need for a hair styling apparatus that enables hair styling in a short period of time without affecting or damaging hair in any way.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Certain embodiments disclosed herein include a hair styling apparatus that includes a heating plate defined by a free end and an attached end. The free end of the heating plate includes a top plate and a bottom plate. A gap is provided between the top and bottom plates configured to receive hair to be styled. The top plate and bottom plate are curved, and concentrically arranged. The gap between the top plate and the bottom plate is adjustable. The hair styling apparatus also includes a lever configured to adjust the gap, and a connecting handle connected to the attached end of the heating plate. The hair styling apparatus further includes a heater attached to the heating plate to provide them with heat, a gripping portion connected to the connecting handle, and a power module configured to supply power to the heater.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
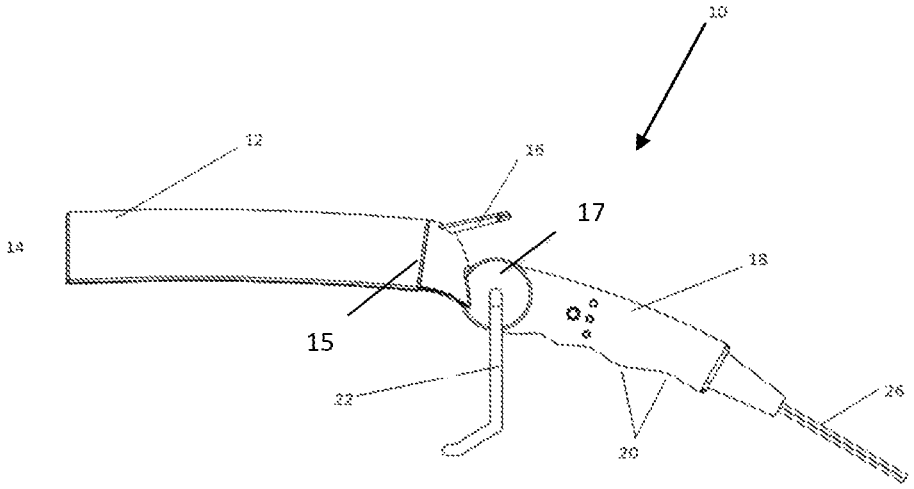
FIG. 1 is a side view of a hair styling apparatus.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the term "or" is generally employed in its sense including "and/or" unless the content clearly dictates otherwise.

Figure 4:
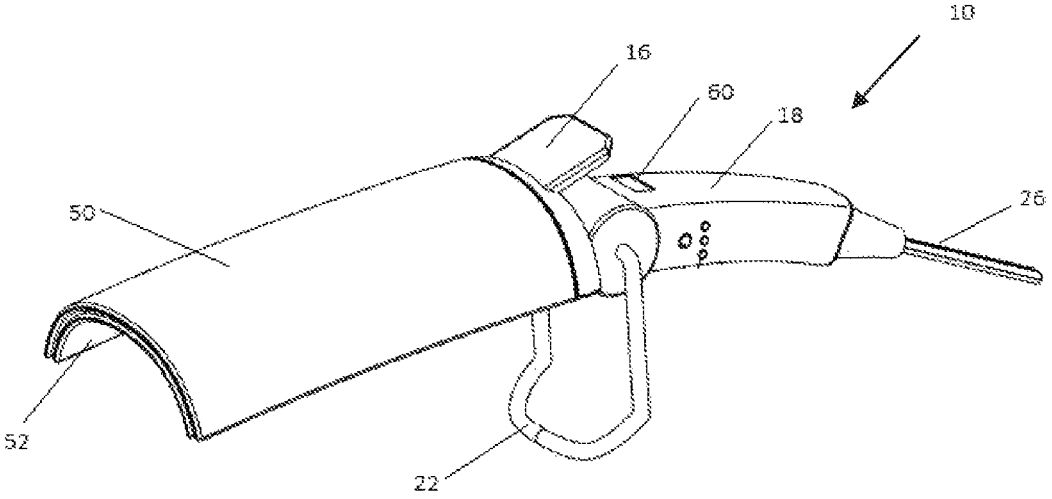
FIG. 4 is a perspective view of the hair styling apparatus.

Referring to FIG. 1, a hair tool 10 includes heating plates 12 that are curved to appear like a U shape both laterally and longitudinally. Also, as best illustrated by FIG. 4, the heating plates 12 further include a top plate 50 and a bottom plate 52 beneath the top plate 50 concentrically arranged to each other when the hair tool 10 is in a closed position.

Figure 2A:
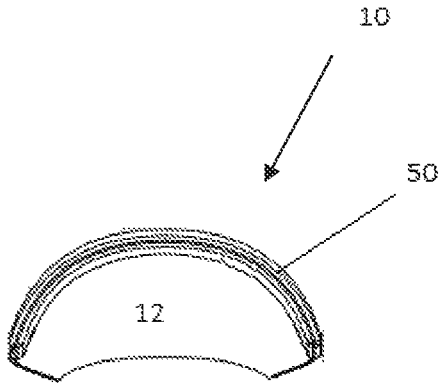
FIG. 2A is a front view of a top plate of the hair styling apparatus.
Figure 2B:
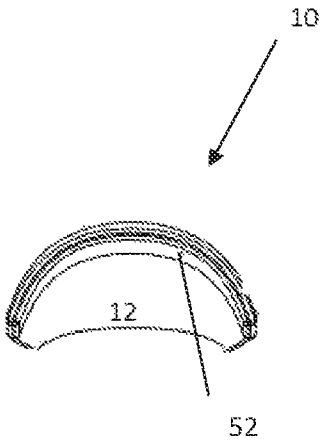
FIG. 2B is a front view of a bottom plate of the hair styling apparatus.

FIG. 2A is a front view of the top plate 50 having multiple concentric layers, and FIG. 2B is a front view of the bottom plate 52 having multiple concentric layers. The heating plates 12 are typically made of a suitable material capable of handling high temperatures, such as for example, but not limited to, ceramic, titanium, alloys of titanium, Teflon, other metals, and the like, and combinations thereof. In one embodiment, an inner side of the heat plate is provided with a metal, preferably titanium. The heating plates 12 are uncovered (i.e., for both the top plate 50 and the bottom plate 52). This allows the heat to penetrate through the hair more evenly and more quickly. This feature works especially well for curling hair. Also, the lack of covering for the heating plates 12 also help maintain the temperature at a certain level, without possibility of overheating, which may cause heat damage to the hair.

Further the heating plates 12 have a free end 14 where the gap between the concentrically arranged heating plates 12 is controllable. Hair to be styled is generally placed or passed through the gap between the concentrically arranged heating plates 12 at the free end 14, typically when the plates are in a heated state that will allow styling of the hair as needed by a user.

Typical means for heating the heating plate involve use of a suitable heater (not shown). In the embodiment, the heater may include Phase Transfer Coefficient (PTC) based heaters, metal-ceramic heaters (MCH), heater based on mica sheet heater, a rope heater, and the like, and combinations thereof. The apparatus further includes a temperature sensor (not shown). Exemplary temperature sensors include negative temperature coefficient (NTC) thermistors or a diode with an aluminum piece. Temperature sensors are used for controlling a preset. The temperature values may be predetermined in a temperature control circuit (not shown), which allows users to set different temperatures.

In an embodiment, there may be three temperature control settings. Each setting can be seen on a display 60 along with the temperature and hair type settings. The temperature control settings allow the user to select the necessary setting for a specific hair type, and prevents heat damage to the hair. Setting 1 will be for fine hair with a temperature setting of 180 degrees Fahrenheit. Setting 2 will be for thick hair with a temperature setting of 200 degrees Fahrenheit. Setting 3 will be for course hair with a temperature setting of 350 degrees Fahrenheit.

Figure 3:
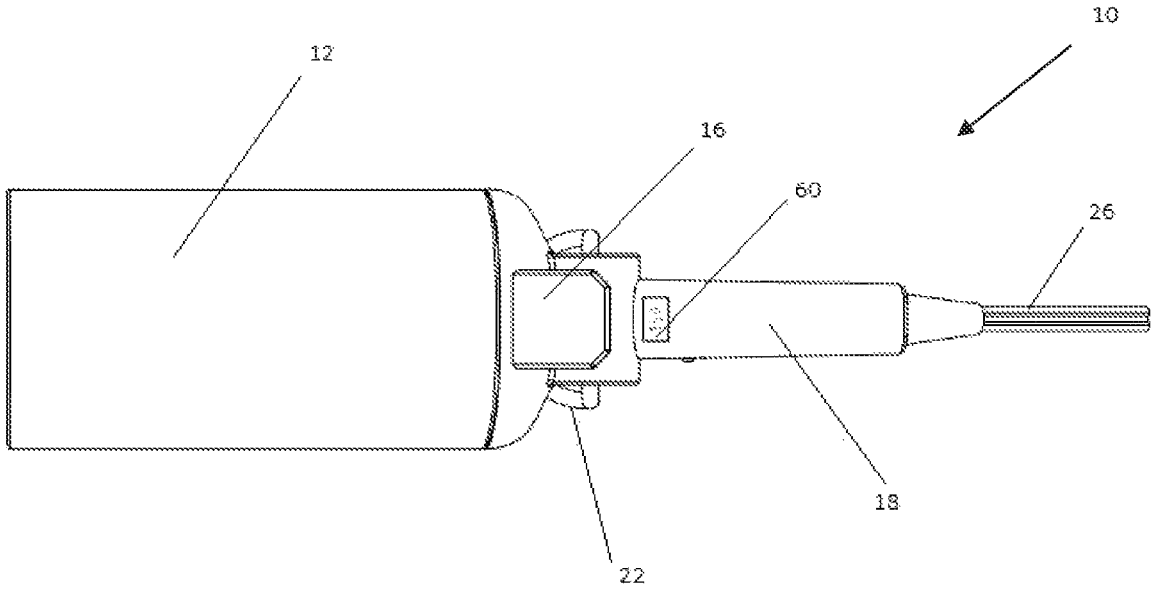
FIG. 3 is a top view of the hair styling apparatus.

In some embodiments, the hair styling apparatus may also include a display 60, as shown in FIG. 3. The display 60 may be configured to display temperature allow the user to see the temperature for the necessary for the heat setting.

Returning to FIG. 1, the gap between the concentrically arranged heating plates 12 is controlled by a lever 16. The gap size may be adjusted by pushing or pulling the lever 16, and then locking the lever 16 at a certain point that corresponds to the predetermined gap size. Examples of locking means may include providing suitable ridges (not shown) whose position corresponds to the appropriate gap size, wherein a protrusion on the lever is allowed to rest on the appropriate ridge. Alternately, a gear-like structure may be provided to achieve the same function. Other ways to use the lever 16 to control gap size may be encompassed within the scope of the disclosure. In the embodiment shown in FIG. 1, the lever 16 is provided on the top end of the hair styling apparatus 10.

Distal from the free end 14 of the heating plates 12 is an attached end 15 that is connected to a connecting handle 18 via a cylindrical midsection 17, through which the rest of the hair styling apparatus 10 is connected to the heating plates 12. In an embodiment, the handle 18 may have finger grip indentations that allow the user to better hold and grip the hair styling apparatus, so that the hair styling apparatus does not easily slip from the user's hand during operation.

In one embodiment, the heating plates 12 are configured to extend outwardly from the connecting handle 18 in a longitudinally curved (i.e., curvilinear across the length of the hair styling apparatus 10 and/or the heating plates 12) or obliquely downward direction relative to the display 60 on the top of the hair styling apparatus, which facilitates ergonomic gripping and holding by the user, and offering better control of the hair styling apparatus while in use. Additionally, the U-shaped curve of the heating plates 12 across the transverse axis of the hair styling apparatus 10 (across a width of the hair styling apparatus 10 and/or the heating plates 12 perpendicular to the longitudinal axis of the hair styling apparatus 10 and/or the heating plates) towards the hair and head of the customer conducts heat more quickly and spreads heat across the hair more evenly than the flat shaped plates. Further, the smooth rounded edges and sides of the plates help shape the hair for the desired style whether it's for straightening, curling or waving.

It is noted that sizes of the heating plates 12 may vary and may be interchanged to accommodate for various lengths of hair. For example, the smaller size apparatus will accommodate the shorter hair lengths, while the larger sizes apparatus will accommodate the longer hair. In more detail, a 1"×5"-sized heating plates 12 may accommodate extreme short hair, a 2"×6"-sized heating plates 12 may be preferable for short hair, a 3"×6.5"-sized heating plates 12 may be preferable for medium length hair, and a 4"×5" and 5"×7.5"-sized heating plates 12 may work best for long hair.

The hair styling apparatus further includes a gripping portion 20 at a distal end of the hair styling apparatus away from the heating plates 12. The gripping portion 20 may include finger indents to enhance gripping by the user. Further, the gripping portion may be made of a suitable material such as a rubber that also enhances gripping by a user. Also, the gripping portion may be made in such a way (e.g., with insulating materials such as plastic, rubber, composites, etc.,) that it is insulated from heat. This would then allow for the user to be protected by the heat emanating from the heating plates 12.

The hair styling apparatus 10 further includes a stand 22 that is configured such that the apparatus can be supported while resting on a surface such as a tabletop or a floor when not in use. FIG. 1 shows on embodiment of the stand 22 that will support the tool while not in use, wherein the stand 22 is configured to be perpendicular to a bottom plate 52 and attached to the cylindrical midsection 17. The cylindrical midsection 17 has a first circular base, a second circular base disposed opposite the first circular base and a curved surface disposed between the first and second bases. A height of the cylindrical midsection is defined by the distance between the first and second circular bases. The stand 22 has a first leg and a second leg connect by a bent portion. The first lea has a first end coupled to the first circular base and a second end opposite the first end. The second lea has a first end coupled to the second circular base and a second end opposite the first end. The bent portion extends in a distal direction from the second ends of the first and second legs and converges to define a central portion of the bent portion.

The hair styling apparatus then includes a power module 26 that allows for heating of the heating plate. The power module 26 may include a DC power source such as a battery, or may be configured to plug into an AC power source.

Battery, when provided, may be of a suitable voltage and wattage as required by the apparatus. Further, batteries may be rechargeable, and may also be conveniently removably provided that will enable removal for external recharging, facile replacement, and so on. Also, battery compartment may be configured to receive a plurality of batteries to achieve the required voltage to power the apparatus.

In some embodiments, the hair styling apparatus 10 may further include the display 60 as shown in FIG. 3 to display any number of messages to the user. The display 60 may be in the form of digits, alphabets, or alphanumeric codes, each of which corresponds to a specific message to inform the user of the apparatus' current status. For example, a message H may be ready to indicate the apparatus is still heating, while R may be used to indicate the apparatus is ready for use, and the like. Typically, a manual is provided to go with the apparatus, wherein the manual lists the codes and their meanings for the user's convenience. A larger display 60 may be used to display more complete words and sentences to convey the status to the user.

Figure 5:
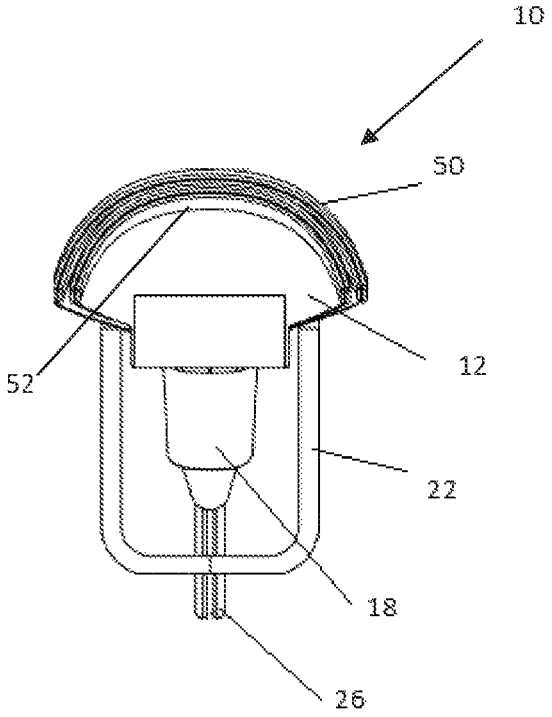
FIG. 5 shows front view of the hair styling apparatus.

FIG. 4 is a perspective view of the hair styling apparatus 10 that shows the top heating plates 50 and includes a bottom plate 52 connected to the handle 18. FIG. 5 is a front view of the hair styling apparatus.

The present disclosure relates to a hair styling apparatus 10 that is versatile to handle any kind of styling (e.g., for straightening, curling, or waving hair). The U-shaped curves of the heating plates 12 allows for efficient heating of the hair strands by allowing heat to transfer through the hair more quickly than the traditional hair styling apparatus. More efficient heat transfer results in hair being exposed to heat for a lesser time, which in turn prevents breakage of hair.

Also, an LED (indication light) as a safety feature is disposed on the hair styling apparatus 10. Therefore, whenever the tool is off, there is no light indication, when the device is on, the indication light will be green. Also, the hair styling apparatus will automatically shut-off when the device is not continuously in use for the last 30 minutes, which prevents the hair styling apparatus 10 from becoming a fire hazard or from needlessly consume electricity.

Further, the hair styling apparatus 10 as disclosed is provided with a stand 22 perpendicular to the bottom plate 52 and attached to the cylindrical midsection 17, which supports the hair styling apparatus 10 while not in use. The stand 22 effectively prevents the occurrence of skin burns while using the device in case of immature use.

Because of the unique design of the hair styling apparatus 10 as disclosed, there is no need to change the plates from the connecting rod 18 for different purposes. That is, the hair styling apparatus 10 may be used to curl, wave, and straighten hair.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It should be understood that any reference to an element herein using a designation such as "first," "second," and so forth does not generally limit the quantity or order of those elements. Rather, these designations are generally used herein as a convenient method of distinguishing between two or more elements or instances of an element. Thus, a reference to first and second elements does not mean that only two elements may be employed there or that the first element must precede the second element in some manner. Also, unless stated otherwise, a set of elements comprises one or more elements.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; 2A; 2B; 2C; 3A; A and B in combination; B and C in combination; A and C in combination; A, B, and C in combination; 2A and C in combination; A, 3B, and 2C in combination; and the like.

What is claimed is:

1. A hair styling apparatus comprising:

a top plate and a bottom plate, the top plate and the bottom plate each having:

i) a perimeter defined by a free end opposite an attached end and first and second lateral sides disposed between the free and attached ends, ii) a width extending between the first and second lateral sides and a length extending between the free and attached ends, iii) an user convex surface and a lower concave surface;

wherein the top and bottom plates are longitudinally curved along their lengths, concentrically arranged, and curved around their width to define a u-shaped cross section, wherein the upper convex surface of the bottom plate is disposed directly under the lower concave surface of the top plate;

a lever attachment having a distal end extending from the attached end of the top plate, a proximal end attached to a cylindrical midsection, and a convex continuous upper surface, wherein the lever attachment tapers in width from the distal end towards the proximal end;

the cylindrical midsection operatively coupled to the attached end of the top plate and the attached end of the bottom plate, comprising:

i) a first circular base and a second circular base opposite the first base, ii) a curved surface disposed between the first and second bases, wherein a height of the cylindrical midsection is the distance between the first and second circular bases and the height extends parallel to the width of the top and bottom plates;

a lever having a proximal end coupled to the convex continuous upper surface of the lever attachment, the lever extending upwardly at an angle and terminating at a distal end, where the lever is disposed above and spaced apart from the cylindrical midsection and is configured to pivot the top plate to adjust a gap between the lower concave surface of the top plate and the upper convex surface of the bottom plate;

a stand extending from the first base and the second base of the cylindrical midsection;

a handle having a first end coupled to the cylindrical midsection and a second end opposite the first end, the handle being curved along a longitudinal direction such that the first end of the handle is disposed above the second end of the handle, wherein the handle includes a gripping portion configured to enhance gripping by a user;

a heater attached to the top and bottom plates; and a power module configured to provide power to the heater.

2. The hair styling apparatus of claim 1, wherein each of the top plate and the bottom plate comprise a plurality of layers.

3. The hair styling apparatus of claim 1, wherein at least one of the top plate and bottom plate is made of titanium.

4. The hair styling apparatus of claim 1, wherein the heater is at least one of a PTC, MCH or combinations thereof.

5. The hair styling apparatus of claim 1, further comprising a display unit.

6. The hair styling apparatus of claim 1, further comprising a temperature display unit.

7. The hair styling apparatus of claim 1, wherein the stand comprises: a first leg having a first end coupled to the first circular base and a second end opposite the first end; a second leg having a first end coupled to the second circular base and a second end opposite the first end; a bent portion extending in a distal direction from the second ends of the first and second leas and converging to define a central portion.

8. The hair styling apparatus of claim 1, wherein the top plate and the bottom plate are shaped symmetrically, and are of substantially the same size.

9. The hair styling apparatus of claim 1, further comprising a temperature control circuit having first, second and third temperature control settings.

10. The hair styling apparatus of claim 9, wherein the first temperature control setting has a temperature setting of 180° F., the second temperature control setting has a temperature setting of 200° F. and the third temperature control setting has a temperature settling of 350° F.

11. The hairstyling apparatus of claim 1, wherein a plurality of indentations are provided along the gripping portion of the handle.

12. A hair styling apparatus comprising:

a top plate and a bottom plate, the top plate and the bottom plate each having:

i) a perimeter defined by a free end opposite an attached end and first and second lateral sides disposed between the free and attached ends, ii) a width extending between the first and second lateral sides and a length extending between the free and attached ends;

iii) an upper convex surface and a lower concave surface and a thickness defined by the distance between the upper convex surface and lower concave surface;

wherein the top and bottom plates are longitudinally curved along their lengths, concentrically arranged and curved around their width to define a u-shaped cross section, wherein the upper convex surface of the bottom plate is disposed directly under the lower concave surface of the top plate and the thickness of the top plate is substantially the same as the thickness of the bottom plate;

a lever attachment having a distal end extending from the attached end of the top plate, a proximal end attached to a cylindrical midsection, and a convex continuous upper surface, wherein the lever attachment tapers in width from the distal end towards the proximal end;

the cylindrical midsection operatively coupled to the attached end of the top plate and the attached end of the bottom plate, comprising:

i) a first circular base and a second circular base opposite the first base, ii) a curved surface disposed between the first and second bases, wherein a height of the cylindrical midsection is the distance between the first and second circular bases and the height extends parallel to the width of the top and bottom plates;

a lever having a proximal end coupled to the convex continuous upper surface of the lever attachment, the lever extending upwardly at an angle and terminating at a distal end, where the lever is disposed above and spaced apart from the cylindrical midsection and is configured to pivot the top plate to adjust a gap between the lower concave surface of the top plate and the upper convex surface of the bottom plate;

a handle having a first end coupled to the cylindrical midsection and a second end opposite the first end, the handle being curved along a longitudinal direction such that the first end of the handle is disposed above the second end of the handle; and a heater attached to the top and bottom plates.

13. The hairstyling apparatus of claim 12, further comprising a stand extending from the first base and the second base of the cylindrical midsection.

* * * * *